United States Patent [19]

Klawitter

[11] Patent Number: 4,635,822

[45] Date of Patent: Jan. 13, 1987

[54] APPARATUS FOR PRODUCING AND SPRAYING A MIXTURE CONSISTING OF AT LEAST TWO COMPONENTS, E.G. LIQUIDS, AND A PROPELLANT GAS

[75] Inventor: Hans J. Klawitter, Munich, Fed. Rep. of Germany

[73] Assignee: F.P.D. Future Patents Development Company S.A., Luxembourg

[21] Appl. No.: 698,800

[22] Filed: Feb. 6, 1985

[30] Foreign Application Priority Data

Feb. 13, 1984 [DE] Fed. Rep. of Germany ..... 3405065

[51] Int. Cl.[4] ..... B67B 7/24

[52] U.S. Cl. ..... 222/82; 222/83.5; 222/136; 222/402.24

[58] Field of Search ..... 222/80–83, 222/90, 91, 129, 135, 136, 145, 394, 402.1, 402.21, 5, 83.5, 402.24

[56] References Cited

U.S. PATENT DOCUMENTS

| | | | |
|---|---|---|---|
| 2,506,983 | 5/1950 | Williams | 222/5 X |
| 2,860,820 | 11/1958 | Falligant | 222/83 X |
| 3,119,528 | 1/1964 | Dunning, Jr. | 222/80 |
| 3,233,780 | 2/1966 | Cheeley | 222/91 X |
| 3,420,033 | 1/1969 | Modderno | 53/36 |
| 3,613,961 | 10/1971 | Morane et al. | 222/389 |
| 3,625,400 | 12/1971 | Friedrich | 222/94 |
| 3,635,261 | 1/1972 | Morane et al. | 141/3 |
| 3,718,235 | 2/1973 | Cronan | 222/5 X |
| 3,834,589 | 9/1974 | Morane et al. | 222/80 |
| 3,865,158 | 2/1975 | Withrow | 222/5 X |
| 4,469,252 | 9/1984 | Obrist | 222/135 |

FOREIGN PATENT DOCUMENTS

| | | |
|---|---|---|
| 1166225 | 3/1964 | Fed. Rep. of Germany . |
| 1959925 | 6/1970 | Fed. Rep. of Germany . |

*Primary Examiner*—Joseph J. Rolla
*Assistant Examiner*—Michael S. Huppert
*Attorney, Agent, or Firm*—Pahl, Lorusso & Loud

[57] ABSTRACT

An apparatus for producing and spraying a mixture consisting of at least two components, e.g. liquids, and a propellant gas, comprising two nested containers for housing the components and the propellant gas and a discharge valve which is disposed at the outer container and has a small discharge tube operable from outside to establish fluid communication with the interior of the outer container. The inner container has a closure including a desired rupture site at its end remote from the discharge valve or facing the bottom of the outer container. The rupture site is adapted to be broken from outside by means of a crusher acting through the bottom of the outer container and establishing fluid communication between the inner and outer containers.

17 Claims, 12 Drawing Figures

FIG. 9
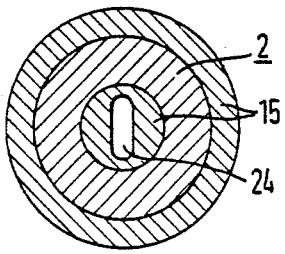
FIG. 6
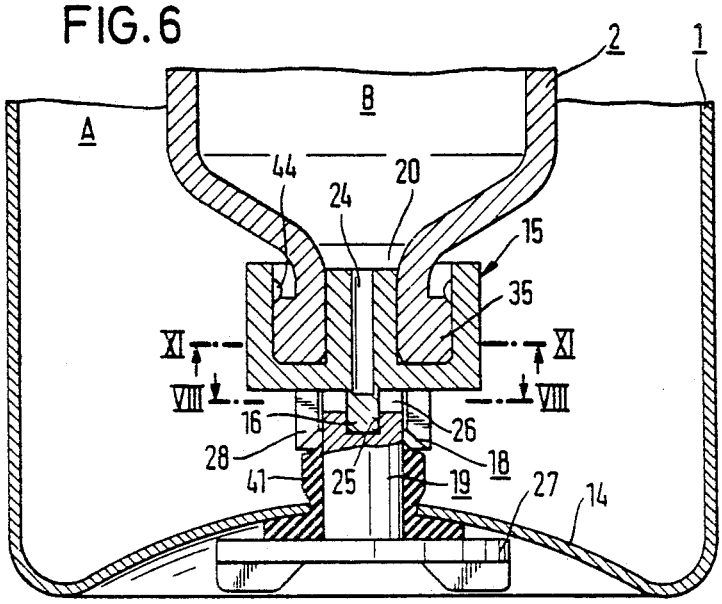
FIG. 8
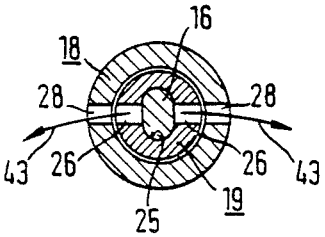
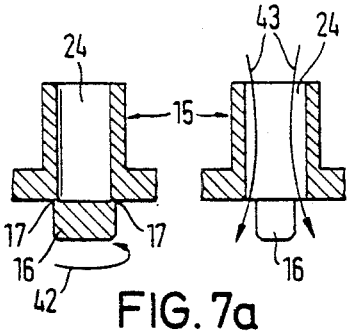
FIG. 7a
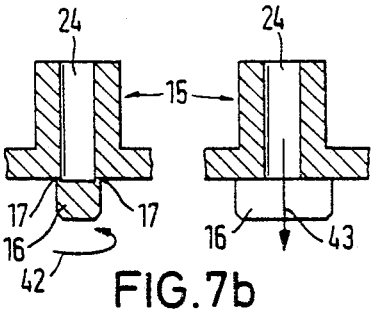
FIG. 7b

APPARATUS FOR PRODUCING AND SPRAYING A MIXTURE CONSISTING OF AT LEAST TWO COMPONENTS, E.G. LIQUIDS, AND A PROPELLANT GAS

The instant invention relates to an apparatus for producing and spraying a mixture consisting of at least two components, e.g. liquids, and a propellant gas, comprising two nested containers for housing the components to be mixed and the propellant gas and a discharge valve which is disposed at the outer container and has a small discharge tube operable from outside to establish fluid communication with the interior of the outer container.

Such apparatus are used wherever different types of material must be stored separately and not be mixed until just before being used. As an example, reference may be made to hair dyes and the like.

The apparatus in question must meet the following requirements:

They must be of simple structure and be producible at corresponding low manufacturing costs;

they must be easy and safe to be handled;

they must be stored safely, i.e. especially any accidental mixing of the components must be avoided;

the individual components must be mixed thoroughly.

In many cases of application, especially also in the case of hair dyes it is recommendable and even necessary that the mixture be available to be dispensed in the form of aerosols or foams. The only apparatus suitable for these applications is an aerosol device (spray can). The prior art is abundant in devices of this kind which have proved to be more or less well suited. To allow for this prior art, reference is made to European patent application No. 82 102 599.6 published under No. 066 28 17 and describing and claiming a further development of the state of the art mentioned in that publication. This further development is characterized in that the inner container is designed to be an independent aerosol container having a separate discharge valve. The internal pressure in the inner container is higher than in the outer container and the discharge valve communicates with the interior of the outer container. The discharge valve of the inner container is coupled kinematically with the discharge valve of the outer container so that normal actuation of the discharge valve of the outer container will open the discharge valve of the inner container. Furthermore, means are provided to hold the discharge valve of the inner container in open position. The means proposed for this purpose include holding clips, detent noses, clamping sleeves, and the like.

A test series made for apparatus produced according to European patent application No. 82 102 559.6 (dual chamber packages) quickly showed that these devices are not suitable for use in practice for several reasons:

The double valve structure comprising two independently movable and yet kinematically coupled small discharge tubes, namely inner and outer discharge tubes is expensive;

the area of the discharge valve coordinated with the inner container gives rise to additional problems of corrosion and sealing;

separate means are needed to hold the discharge valve of the inner container in open position, and the functioning of these separate means is not always assured, especially not because of influences of corrosion;

a riser must be connected to the inner discharge tube within the inner container.

It is, therefore, an object of the instant invention to provide an apparatus which is much simpler than the state of the art and with which especially any coupling between an outer discharge valve and an inner discharge valve is avoided and the material may be discharged from the inner container even without a riser.

This object is met, in accordance with the invention in that the inner container has a desired rupture site at its end remote from the discharge valve or facing the bottom of the outer container, said rupture site being adapted to be broken from outside by a crusher acting through the bottom of the outer container and establishing fluid communication between the inner and outer containers. The structure according to the invention permits the mixture to be discharged by way of a commercially available aerosol discharge valve. The opening of the inner container and thus the mixing of the two components is effected irrespective of the actuation of the outer discharge valve, the means for opening the inner container being characterized by minimum structural expenditure. The design according to the invention further makes it possible to dispense with a riser connected to the opening or discharge tube of the inner container. This is an additional contribution to lowering the manufacturing costs.

Preferred structural further developments of the invention are defined in the subclaims. The embodiments recited in claims 4 to 9 are characterized by especially simple handling. All that is needed to open the inner container or to prepare a mixture in the interior of the outer container is to introduce the puncher in the axial passage of the closure plug provided in the bottom of the outer container and then press the bottom of the outer container against a support. This will break up not only the diaphragm of the outer closure plug but also the diaphragm of the inner closure plug to establish fluid communication between the interior of the inner container and the interior of the outer container.

The embodiments as recited in claims 10 to 17, on the other hand, have the advantage that the rotary pin serving as crusher forms part of the outer container. This means that a self-contained package unit is provided.

The invention will be described further, by way of example, with reference to the accompanying drawings, in which.

Figure 1:
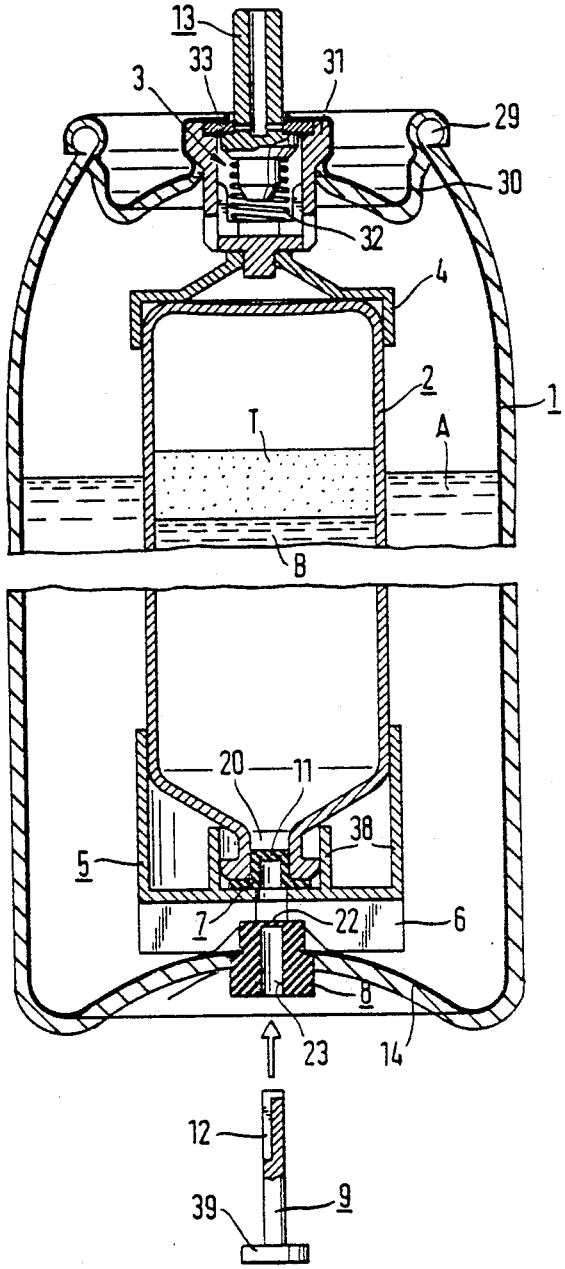
FIG. 1 is a longitudinal or axial section of an apparatus according to the invention or a dual chamber container designed according to the invention.
Figure 3:
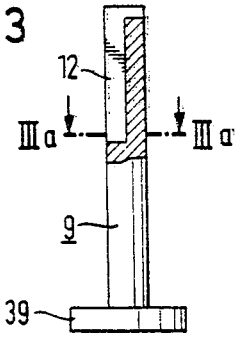
FIG. 3 is an elevation, partly in section, of a crusher in the form of a puncher serving to establish fluid communication between the interior of the inner container and the interior of the outer container.
Figure 3A:
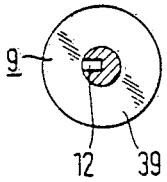
Figure 3B:
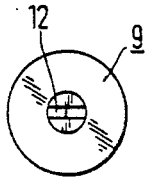
Figure 4:
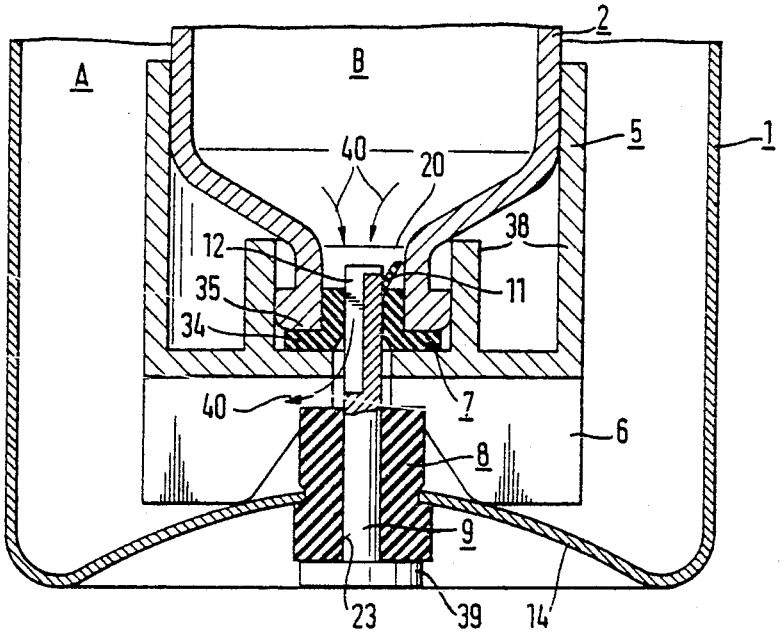
Figure 5:
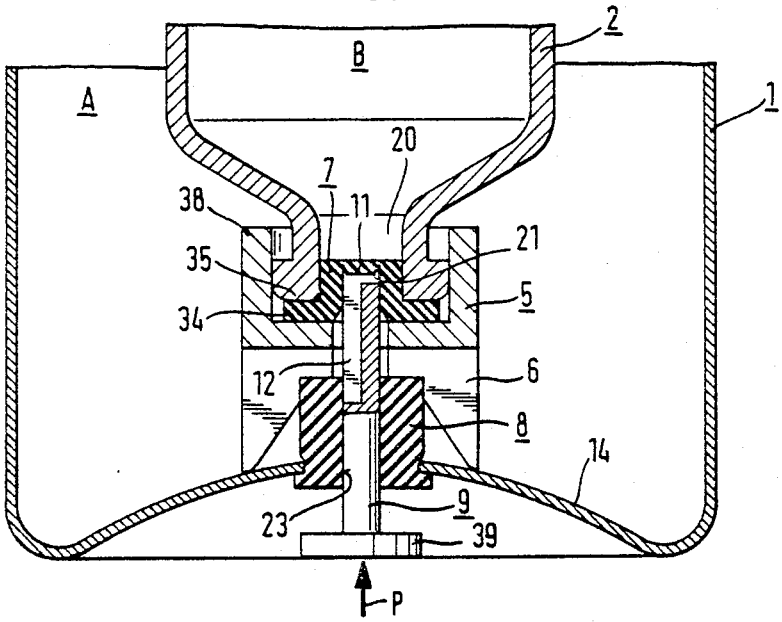

FIGS. 3*a* and 3*b* show the puncher according to FIG. 3 in cross section and plan view, respectively;

FIG. 4 is a sectional view of the lower part of the dual chamber container according to FIG. 1 showing the open or ruptured inner container;

FIG. 5 is a sectional view of a modified embodiment of the lower part of the dual chamber container according to FIG. 1 in a condition prior to use;

FIG. 6 is a sectional view of the lower part of a dual chamber container according to the invention including a modified opening mechanism for the inner container;

FIGS. 7*a* and 7*b* show part of the opening mechanism according to FIG. 6 in two longitudinal sections rotated by 90° and each in closed and open conditions;

FIG. 8 is a sectional view along line VIII—VIII in FIG. 6 of part of the opening mechanism; and FIG. 9 is a sectional view along line IX—IX of part of the opening mechanism for the inner container.

As shown in FIG. 1, the apparatus or dual chamber container comprises an outer standard aerosol container 1 including an aerosol discharge valve 3 which is set in the usual manner in a cover 30 fixed tightly in an opening edge 29 of the container 1. It also comprises an inner container 2. Like the outer container 1, also the inner container is made of corrosion resistant material. The outer container 1 contains a filling component A, while the inner container 2 contains a filling component B and a suitable propellant T, usually a readily liquifiable gas, such as butane propane, and the like. The inner filling component B may be hydrogen peroxide, for instance, and the outer filling component A may be a dyestuff. The dimensions of containers 1 and 2 depend on the volume of filling material to be dispensed and on their ratio. The maximum diameter of the inner container 2 may be slightly less than that of the opening edge 29 of the outer container 1 so that the inner container 2 still can be inserted through this opening into the outer container 1. These dimensions are standard for current sizes.

The discharge valve 3 fixed in the cover 30 consists of a valve body 31 and of a small actuating or discharge tube 13 which is supported for axial inward movement in the valve body and through which the mixture may be taken out of the interior of the outer container 1. The small discharge tube 13 is movable axially inwardly against the action of a helical spring 32 which has one end supported on the valve body 31, while its other end rests on an annular shoulder 33 formed integral with the small discharge tube 13. As clearly shown in FIG. 1, valve body 31 is anchored in formlock and forcelock in the cover 30. Also the inner container 2 is supported on the valve body 31 by a support 4 effective in axial and radial or lateral directions. Preferably the support 4 is designed as a spring element acting in axial direction and pressing the inner container 2 against a lower container support 5. The inner container 2 is arranged within the outer container 1 with a bottleneck opening 20 directed downwardly. The bottleneck opening 20 is closed by a closure plug 7 made of plastics, rubber, and the like. The closure plug 7 has the shape of a hat and its outer edge 34 is fixed between the edge 35 of the opening 20 of the inner container 2 and the container support 5 (cf. FIG. 2). The closure plug 7 comprises a diaphragm 11 which closes the opening 20 and preferably has a slightly thinner wall than the remainder of the closure plug 7. In the embodiment shown it is defined by a notched annulus 21 to facilitate its breaking. In this manner a desired rupture site is defined in the inner closure plug 7.

Figure 2:
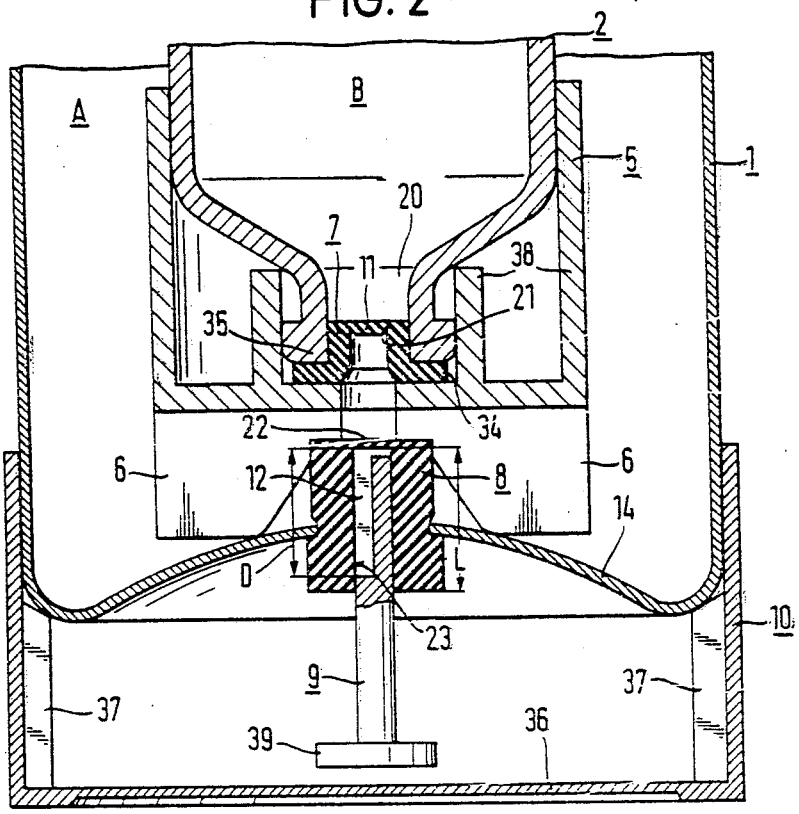
FIG. 2 shows the lower part of the dual chamber container according to FIG. 1 on an enlarged scale and in a condition prior to use or ready for storing or transportation.

The diaphragm 11 is adapted to be broken from outside by a crusher acting through the bottom 14 of the outer container 1 and establishing fluid communication between the inner and outer containers. In the case of the embodiment shown in FIGS. 1 to 5 the crusher is embodied by a pin-like puncher 9 having an approximately circular cross section (cf. FIGS. 3*a* and 3*b*). As clearly shown in FIGS. 3 and 4, the pin- or bolt-like puncher 9 is adapted to be pressed through a closure plug 8 made of rubber, plastics, and the like and disposed in the bottom 14 of the outer container 1, at the same time, maintaining a fluid-tight seal between the interior of the outer container and atmosphere. The closure plug 8 also comprises a thin walled diaphragm 22 which may be defined by a notched annulus, if desired, and which is adapted to be pushed open by the puncher 9 in the case of the embodiment shown in FIGS. 3 and 4. The diaphragm 22 is located at the end inside the container of an axial guide passage for the puncher 9, which passage is embodied by a blind bore 23 having an inner diameter corresponding to the outer diameter of the puncher 9. Moreover, the diaphragm 22 of the outer closure plug 8 is aligned with the diaphragm 11 of the inner closure plug 7. The puncher 9 is formed with a passage for the exit of component B and propellant gas from the inner container 2 into the interior of the outer container 1. This passage has the form of a longitudinal groove 12 whose axial extension D is smaller than the length L of the blind bore 23 in the outer closure plug 8. Thus it is assured that no component A from the interior of the outer container 1 may issue through the bore 23 when the diaphragm 22 of the outer closure plug 8 is broken. The dual chamber container preferably is made available in the condition as shown in FIG. 2. It is obvious that the puncher 9 is pushed into the bore 23 until it stops at the diaphragm 22. Accidental breaking of the diaphragm 22 during shipment is avoided by the provision of an outer protective cap 10 which is pushed or slid on the bottom end of the outer container 1. The necessary spacing between the end wall 36 of the protective cap 10 and the bottom 14 of the outer container 1 is obtained by longitudinal fins 36 arranged inside the protective cap 10 and preferably formed integral with the same.

The inner container 2 is supported axially and laterally in the bottom range of the outer container 1 resting on the outer closure plug 8 by way of support element 5 which is formed with a pot-shaped receptacle 38 for the lower part of the inner container 2 and centering fins 6 cooperating with that part of the closure plug 8 which projects into the interior of the container. At least three centering fins 6 are provided uniformly spaced along the circumference. The puncher 9 is provided at its end projecting from the outer container 1 or the outer closure plug 8 with a pressure plate 39 which will facilitate the pushing of the puncher.

FIG. 4 shows the puncher in fully pressed-in condition. Both the diaphragm 22 of the outer closure plug 8 and the diaphragm 11 of the inner closure plug 7 are ruptured. The filling component B may issue from the interior of the inner container 2 through the longitudinal groove 12 into the interior of the outer container 1 (see arrows 40) where it may be mixed with the component A.

With the embodiment shown in FIG. 5 the outer closure plug 8 has no closing diaphragm 22. For this reason the puncher 9 must be inserted into the bore 23 until it abuts against the diaphragm 11 of the inner closure plug 7. This will guarantee a fluid seal between the interior of the outer container 1 and atmosphere. For use, the puncher 9 must be pressed entirely into the interior of the container, in the direction of arrow P so as to rupture the diaphragm 11 and establish fluid communication, as shown in FIG. 4.

The embodiment illustrated in FIGS. 6 to 9 differs from the embodiment described above as regards the opening mechanism for the inner container 2. The closure of the inner container 2 or the bottleneck container opening 20 is effected by a cap 15 placed on the opening and having a channel-like passage 24 which is closed by a cover connected to or formed integral with the cap 15 by thin walled webs 17 and adapted to be broken off by a crusher operable from outside. The cover is embodied by a projection 16 having an approximately rectangular cross section and being engaged with the crusher which is designed as a rotary pin 19. To this end the rotary pin has a depression or recess 25 at its front end, the cross section of this recess corresponding to that of the projection 16. The rotary pin 19 is supported for rotation in the bottom 14 of the outer container 1, specifically in a plug-like bearing 41 of rubber or plastics which, at the same time, guarantees a fluid-tight seal between the interior of the outer container 1 and atmosphere. Rotation of the rotary pin 19 is facilitated by a handle 27 disposed at and preferably formed integral with the outer end of the rotary pin 19 projecting from the outer container 1. At its inner front end the rotary pin 19 further comprises two diametrically disposed and radially extending passages 26 through which fluid communication between the interior of the outer container 1 and the channel-like passage 24 in the closure cap 15 and thus the interior of the inner container 2 can be established when the cover or projection 16 is broken. The rotary pin 19 also serves as lateral or radial support or for centering the inner container 2 in the bottom range of the outer container 1. This support is afforded by a bearing sleeve 18 arranged at and preferably formed integral with the side of the closure cap 15 facing the bottom 14 of the outer container 1 and surrounding the free end of the rotary pin 19. Also the bearing sleeve 18 is formed with two diametrically arranged apertures 28 which each extend in radial direction and serve to establish the fluid connection mentioned between the interior of the outer container 1 and the channel-like passage 24 in the closure cap 15 and thereby the interior of the inner container 2, when the cover or projection 16 has been broken off (cf. especially FIG. 8).

As may be taken from FIGS. 6 to 9 the embodiment shown has the bottleneck opening 20 of the inner container closed by a cap 15 formed with a central passage 24 which is closed by a cover of the kind of a projection 16 which is connected to the cap 15 by thin walled webs 17 which are easily broken. Preferably the passage 24 has an approximately rectangular cross section, as may be gathered from FIGS. 7*a*, 7*b*, and 9. Providing a projection 16 of corresponding shape, rotation thereof with respect to the passage 24 by approximately 90° will establish fluid communication between the channel-like passage 24 or the interior of the inner container 2 and the interior of the outer container 1 (see arrows 43 in FIGS. 7*a* and 7*b*).

The projection 16 also could be broken by a tipping lever to be actuated from outside and supported for elastic tipping movement on the bottom 14. However, the embodiment shown in FIGS. 6 to 9 is characterized by a space-saving structure and thus to be preferred as against a tipping lever mechanism. Of course, the rotary pin 19 is supported so as to be held axially in the bottom 14 of the outer container 1.

Cap 15 is held in place by beads or ridges 44 and the like engaging behind the edge 35 of the opening of the inner container 2. The inner container 2 is supported axially in downward direction by the cap 15 and the rotary pin 19. Preferably the closure plug shown in FIGS. 1 to 5 forms an integral part of the lower support 5, i.e. the closure plug 7 and the support 5 are a one-piece member. Furthermore, the end of the puncher 9 inside the container preferably may be tapered somewhat to facilitate the rupture both of the diaphragm 22 and of the diaphragm 11.

All features disclosed in the present documents are claimed as essential of the invention to the extent that they are novel as compared to the state of the art, both individually and in combination.

What is claimed is:

1. An apparatus for producing and spraying a mixture consisting of at least two components, e.g. liquids and a propellant gas, comprising two nested containers for housing the components to be mixed and the propellant gas and a discharge valve which is disposed at the outer container and has a small discharge tube operable from outside to establish fluid communication with the interior of the outer container, wherein the inner container has a desired rupture site at its end remote from the discharge valve, facing the bottom of the outer container, the rupture site being adapted to be broken from outside by a crusher acting through the bottom of the outer container and establishing fluid communication between the inner and outer containers, and wherein the desired rupture site is adapted to be pushed open or broken by a pin-like puncher passed through a closure member arranged in the bottom of the outer container, the puncher including a passage to permit the exit of the components located in the inner container directly into the interior of the outer container, the axial extension of this passage being smaller than the length of the axial passage for the puncher formed in a closure member of the outer container.

2. The apparatus as claimed in claim 1, characterized in that the desired rupture site of the inner container is part of a closure plug made of a corrosion resistant material and adapted to be inserted in the inner container opening.

3. The apparatus as claimed in claim 2, characterized in that the desired rupture site is a thin wall diaphragm which is defined by a notched annulus.

4. The apparatus as claimed in claim 1, characterized in that the puncher is adapted to be slid or pushed through the closure member arranged in the bottom of the outer container, thus maintaining a fluid seal between the interior of the outer container and atmosphere.

5. The apparatus as claimed in claim 4, characterized in that the closure member disposed in the bottom of the outer container comprises a thin walled diaphragm defined by a notched annulus adapted to be thrust open by the puncher.

6. The apparatus as claimed in claim 5, characterized in that the diaphragm of the closure member is disposed in the bottom of the outer container is approximately aligned with the diaphragm of the closure plug of the inner container.

7. The apparatus as claimed in claim 5, characterized in that the diaphragm of the closure member disposed in the bottom of the outer container is arranged at the end inside the container of an axial passage for the puncher.

8. The apparatus as claimed in claim 1, characterized in that the inner container is supported both laterally and axially, in the bottom range of the outer container by a pot shaped support element which is supported by the closure member disposed in the bottom of the outer container.

9. The apparatus as claimed in claim 1, characterized in that an upper support of the inner container which support faces the discharge valve acts downwardly on the inner container against the bottom of the outer container.

10. The apparatus as claimed in claim 1, characterized in that the desired rupture site of the inner container is part of a cap closing the container opening and having a channel-like passage such that the latter is closed by a cover which is connected to the cap by thin walled webs and operationally connected to a crusher adapted to be actuated from outside.

11. The apparatus as claimed in claim 10, characterized that the cover has a projection which is in engagement with the crusher.

12. The apparatus as claimed in claim 11, characterized in that the crusher is a pin supported for rotation in the bottom of the outer container and having at its front end a recess to receive the projection formed integral with the closure cap of the inner container.

13. The apparatus as claimed in claim 12, characterized in that the rotary pin has at least one radially extending passage at its front end to establish fluid communication between the interior of the outer container and the channel-like passage in the closure cap and thus the interior of the inner container when the cover or projection has been broken.

14. The apparatus as claimed in claim 12, characterized in that a rotary handle is formed integral with that portion of the rotary pin which projects out of the outer container.

15. The apparatus as claimed in claim 12, characterized in that the rotary pin serves as a lateral and radial support and for centering the inner container within the outer container, the support being afforded by a bearing sleeve which is disposed at, and formed integral with, that side of the closure cap facing the bottom of the outer container and which surrounds the free end of the rotary pin.

16. The apparatus as claimed in claim 15, characterized in that the bearing sleeve has lateral apertures to assure fluid communication between the interior of the outer container and the channel-like passage in the closure cap and thus the interior of the inner container when the cover or projection has been broken.

17. The apparatus as claimed in claim 11, characterized in that both the projection and, in corresponding manner, the recess formed in the front end of the rotary pin to take up the projection have a correspondingly shaped torque transmitting cross section, the width of the projection being less than the cross-sectional length of the channel-like passage in the closure cap which passage likewise has an approximately rectangular cross section corresponding to the cross section of the projection.

* * * * *